US011318517B2

(12) United States Patent
Sohmshetty et al.

(10) Patent No.: US 11,318,517 B2
(45) Date of Patent: May 3, 2022

(54) SYSTEM AND METHOD FOR HEATING METAL BLANKS

(71) Applicant: Ford Global Technologies, LLC, Dearborn, MI (US)

(72) Inventors: Raj Sohmshetty, Canton, MI (US); Elizabeth Bullard, Royal Oak, MI (US); Kyle Lee Fleeger, Westland, MI (US); Robert Hess, Dearborn, MI (US); Nguyen Phan, Allen Park, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 4 days.

(21) Appl. No.: 17/039,451

(22) Filed: Sep. 30, 2020

(65) Prior Publication Data

US 2022/0097115 A1 Mar. 31, 2022

(51) Int. Cl.
*B21D 22/02* (2006.01)

(52) U.S. Cl.
CPC ..... *B21D 22/022* (2013.01)

(58) Field of Classification Search
CPC .... B21D 22/022; B21D 43/00; B21D 43/003; B21D 43/021; B21D 43/023; B21D 43/26; B21D 43/105; B65G 13/00; B65G 21/2072; B65G 37/00; B65G 43/00; B65G 47/244; F27D 2003/0001; F27D 2003/0062; F27D 2003/2001; F27B 9/208; F27B 9/14; C21D 1/34; C21D 9/0056; C21D 9/0054
See application file for complete search history.

(56) References Cited

U.S. PATENT DOCUMENTS 8,790,064 B2 * 7/2014 Dorner ..... B23Q 7/18 414/783
2017/0100760 A1 * 4/2017 Hahn ..... B65G 37/00

FOREIGN PATENT DOCUMENTS

| | | |
|---|---|---|
| CN | 103372573 | 12/2015 |
| CN | 109353815 | 2/2019 |
| KR | 101837056 | 3/2018 |

* cited by examiner

*Primary Examiner* — Christopher J Besler
*Assistant Examiner* — Christine Bersabal
(74) *Attorney, Agent, or Firm* — Burris Law, PLLC

(57) ABSTRACT

A method of adjusting a position of a blank entering a furnace includes measuring a position of a heated blank exiting the furnace, recording one or more offset values from a nominal value of the heated blank exiting the furnace, calculating a revised position of a subsequent blank entering the furnace as a function of the one or more offset values, and adjusting a position of the subsequent blank entering the furnace as a function of the one or more offset values. The position of the heated blank exiting the furnace can be measured with an electronic vision system, a robot can adjust the position of the subsequent blank, and offset value(s) can be an elapsed furnace operation time, a number of heated blanks that have exited the furnace, and a physical dimension between an actual position of the heated blank and the nominal value of the heated blank.

20 Claims, 9 Drawing Sheets

SYSTEM AND METHOD FOR HEATING METAL BLANKS

FIELD

The present disclosure relates to heating material, and particularly to heating metal blanks for assembly line production.

BACKGROUND

The statements in this section merely provide background information related to the present disclosure and may not constitute prior art.

Metal blanks (i.e., generally flat pieces of metal removed from a primary metal strip or sheet) are used for the manufacture of components such as vehicle B-pillars, door side impact beams, roof rails, among others. Also, hot stamping of metal blanks to form a component commonly includes heating the metal blanks in a furnace prior to be transferred to a hot stamping press.

Furnaces used to heat metal blanks prior to hot stamping include continuous roller furnaces rollers that move or transport the metal blanks from an entry end of the furnace to an exit end. And movement of metal blanks through a continuous roller furnace heats the metal blanks to within a desired temperature range for a desired time period such that hot stamping of the metal blanks produces components with a desired microstructure and mechanical properties.

Maintenance of such continuous roller furnaces adds to the cost of hot stamped components, particularly when unscheduled stoppage of a continuous roller furnace and an associated manufacturing line occur, and/or blanks transported through the furnace have not been properly heat treated, cannot be used for their intended purposed, and must be scrapped.

These issues with furnace maintenance, along with other issues related to heating metal blanks, are addressed by the present disclosure.

SUMMARY

In one form of the present disclosure, a method of adjusting a position of a blank entering a furnace includes measuring a position of a heated blank exiting the furnace, recording one or more offset values from a nominal value of the heated blank exiting the furnace, calculating a revised position of a subsequent blank entering the furnace as a function of the one or more offset values, and adjusting a position of the subsequent blank entering the furnace as the function of the one or more offset values. In some variations, the position of the heated blank exiting the furnace is measured with an electronic vision system.

In at least one variation of the present disclosure, the one or more offset values comprise at least one of an elapsed furnace operation time during a heating campaign, a number of heated blanks that have exited the furnace during the heating campaign, and a physical dimension between the position of the heated blank exiting the furnace and the nominal value of the heated blank exiting the furnace. In some variations, the physical dimension is at least one of a width offset value, a length offset value, and an angle offset value of the measured position of the heated blank exiting the furnace and a nominal position of the heated blank exiting the furnace.

In at least one variation, measuring the position of the heated blank includes measuring the position of a plurality of heated blanks exiting the furnace, and adjusting the position of the subsequent blank includes adjusting the position of a plurality of subsequent blanks entering the furnace. In some variations, adjusting the position of the plurality of subsequent blanks comprises adjusting the position of at least a subset of the plurality of subsequent blanks along a width direction of a furnace entry station. And in at least one variation adjusting the position of the plurality of subsequent blanks includes adjusting at least one of a width placement value, a length placement value, and an angle placement value of at least a subset of the plurality of subsequent blanks relative to a length direction of a conveyor transporting the plurality of subsequent blanks through the furnace.

In some variations, adjusting the position of the subsequent blank includes adjusting the position of a plurality of subsequent blanks during a first phase protocol and a second phase protocol. In such variations, the first phase protocol can include adjusting a position of a first subset of the plurality of subsequent blanks entering the furnace along a width direction of a furnace entry station. In some variations, the second phase protocol includes adjusting a position of a second subset of the plurality of subsequent blanks entering the furnace about an angle relative to a length direction of the conveyor transporting the plurality of subsequent blanks through the furnace. In at least one variation, the method includes commanding a robot to adjust the position of the first subset of the plurality of subsequent blanks during the first phase protocol and to adjust the position of the second subset of the plurality of subsequent blanks during the second phase protocol. In some variations, the robot continually adjusts the first subset of the subsequent blanks along the width direction of the furnace entry station until a predefined length of rollers is used to transport the plurality of subsequent blanks through the furnace during the first phase protocol.

In at least one variation, the furnace is a roller furnace. And in some variations, the first blank and the subsequent blank are coated steel blanks, for example, aluminum coated steel blanks.

In at least one variation, the method includes hot stamping the first blank.

In another form of the present disclosure, a method of adjusting positions of blanks entering a hot stamping furnace includes measuring positions of a plurality of heated blanks exiting the hot stamping furnace with an electronic vision system, determining and recording one or more offset values from a nominal value for at least a portion of the plurality of heated blanks exiting the hot stamping furnace, and commanding a robot to adjust positions of a plurality of subsequent blanks entering the hot stamping furnace as a function of the one or more offset values. In some variations, the robot adjusts the positions of the plurality of subsequent blanks along a width direction of a furnace entry station. In at least one variation, the robot adjusts the positions of the plurality of subsequent blanks about an angle relative to a length direction of a conveyor transporting the subsequent blanks into the hot stamping furnace.

In still another form of the present disclosure, a method of adjusting positions of blanks entering a hot stamping furnace includes measuring positions of a plurality of heated blanks exiting the hot stamping furnace, determining one or more offset values from nominal values for at least a portion of the plurality of blanks, calculating at least one revised position of a plurality of subsequent blanks that will enter the hot stamping furnace as a function of the one or more offset values, and commanding a robot to place the plurality of subsequent blanks at the at least one revised position before entering the hot stamping furnace. In some variations, the one or more offset values include at least one of a number of blanks that have exited the hot stamping furnace, an elapsed time of operation of the hot stamping furnace, and a difference between the measured positions of the plurality of blanks that have exited the hot stamping furnace and at least one nominal position of the plurality of blanks that have exited the hot stamping furnace.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
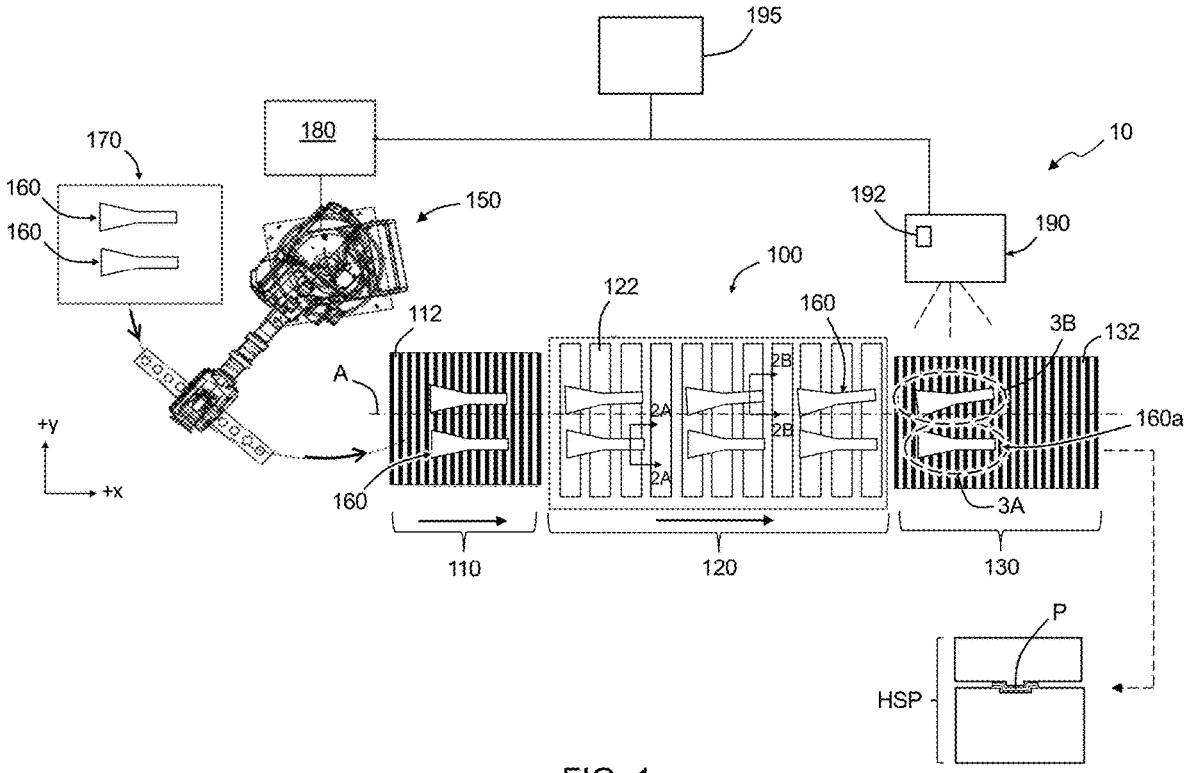
FIG. 1 shows a system with robot loading metal blanks onto a furnace entry station, a continuous roller furnace heat the metal blanks, a furnace exit station, and an electronic vision system viewing and recording positions of metal blanks exiting the continuous roller furnace according to the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Referring to FIG. 1, a system 10 for heating metal blanks (also referred to herein simply as "blanks") 160 in a furnace 100 is shown. The enclosure of the furnace 100 is not shown in the figures for clarity. The system 10 includes a furnace entry station 110, the furnace 100 with a furnace conveyor 120, and a furnace exit station 130. A robot 150 grasps metal blanks 160 from a station or container 170 and delivers the metal blanks 160 to the furnace entry station 110. In some variations, the robot 150 places or positions the metal blanks 160 on the furnace entry station 110 at a predetermined location and/or predetermined position. As used herein the term "position" refers to an x and y position of a metal blank 160 in an x-y reference plane shown in the figures and an angle of rotation (θ) of the metal blank 160 relative to a length direction of the furnace conveyor 120.

In some variations, the furnace entry station 110 has a plurality of rollers 112 that rotate and thereby transport the metal blanks 160 to the furnace conveyor 120. In at least one variation, the furnace 100 is a continuous roller furnace and the furnace conveyor 120 has a plurality of rollers 122 that rotate and thereby move or transport the metal blanks 160 from the furnace entry station 110, through the furnace 100 and to the furnace exit station 130. In some variations, the furnace 100 is a hot stamping furnace 100 (i.e., provides heated metal blanks for subsequent hot stamping) and/or the furnace exit station 130 has a plurality of rollers 132.

During movement or transport of the metal blanks 160 through the furnace 100, the metal blanks 160 are heated to within at least one desired temperature range for at least one desired time period before being delivered to the furnace exit station 130 as heated blanks 160*a*. Another robot (not shown) can be positioned at the furnace exit station 130 and be configured to grasp and move the heated blanks 160*a* from the furnace exit station 130 to a hot stamping press 'HSP.' That is, in some variations of the present disclosure metal blanks 160 are heated in the furnace 100 to provide heated blanks 160*a* that are hot stamped at the hot stamping press 'HSP' to produce a hot stamped part 'P.' As used herein, the phrase or term "hot stamping" refers to forming heated metal blank at an elevated temperature in a die and subsequently quenching the formed metal blank in the die. One non-limiting example of hot stamping is the hot forming a boron steel at a temperature above 900° C. in a water cooled die cavity to form a desired shape and holding the hot formed boron steel within the water cooled die cavity for 1 to 20 seconds to quench the hot form boron steel such that an austenite microstructure of the boron steel at 900° C. is transformed to martensite.

It should be understood that subjecting the metal blanks 160 to the least one desired temperature range for the at least one desired time period (also referred to herein as a "time-temperature profile") in the furnace 100 provides the hot stamped part P with a desired microstructure and mechanical properties. For example, the combination of heating the metal blanks 160 in the furnace 100 and hot stamping the heated blanks 160*a* with the hot stamping press HSP provides a light weight high-strength component for use in a vehicle. In addition, it should be understood that the furnace 100 can include a plurality of different zones or heating sections such that the metal blanks are subjected to a range of different temperatures or different temperatures ranges while moving through the furnace 100.

Figure 2A:
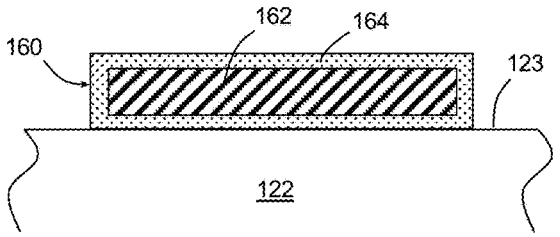
FIG. 2A is a sectional view of section 2A-2A of a metal blank in FIG. 1.
Figure 2B:
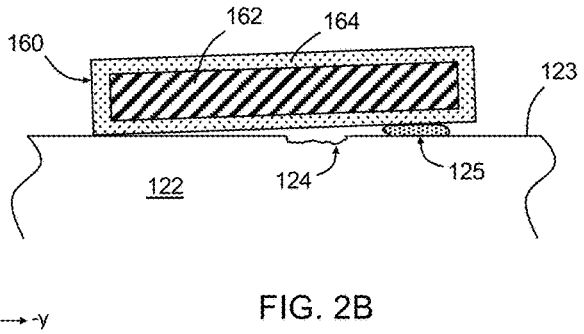
FIG. 2B is a sectional view of section 2B-2B of a metal blank in FIG. 1.

Referring to FIGS. 2A-2B, in some variations of the present disclosure the metal blanks 160 are coated with a corrosion resistant coating prior to entry into the furnace 100 and the time-temperature profile in the furnace 100 provides a desired bonding and/or microstructure between the corrosion resistant coating and the metal blanks 160. For example, the metal blanks 160 shown in FIGS. 2A-2B have a steel substrate 162 and an aluminum (Al) or Al alloy coating 164 on the steel substrate 162. One non-limiting example of the steel substrate 162 is Usibor® 1500 steel and non-limiting examples of the corrosion resistant coating 164 include aluminum alloy coatings and aluminum-silicon alloy coatings such as AS150.

Still referring to FIGS. 2A-2B, a metal blank 160 is positioned on or laying flat on a roller 122 in FIG. 2A and another metal blank 160 is not laying flat on a roller 122 in FIG. 2B. Particularly, heating the metal blanks 160 in the furnace 100 results in damage to the rollers 122 such as pits or cavities 124 and/or buildup of coating deposits 125 as shown in FIG. 2B. Also, damaged rollers 122 result in metal blanks 160 moving through the furnace 100 being displaced or shifted from a desired nominal position at the furnace exit station 130. Stated differently, as the rollers 122 in the furnace 100 experience increasing deposit buildup and damage, the position(s) the heated blanks 160*a* have at the furnace exit station 130 prior to being transported to the hot stamping press HSP can change with time. Also, when the heated blanks 160*a* are displaced or shifted from the desired nominal position at the furnace exit station 130 beyond a certain amount (i.e., a tolerance or an offset parameter), the furnace 100 must be "shut-down" for maintenance of the furnace and repair or replacement of the rollers 122.

Figure 3A:
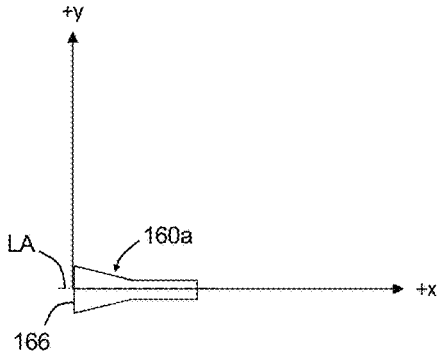
FIG. 3A is a graph showing a nominal position '3A' of a heated metal blank in FIG. 1.
Figure 3B:
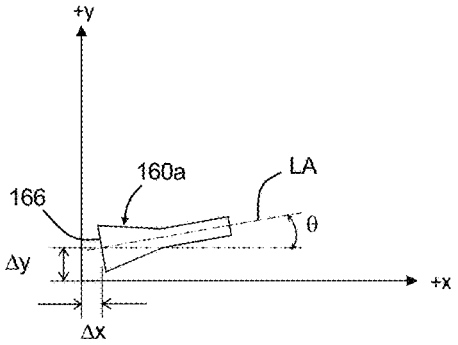
FIG. 3B is a graph showing offset values for an offset position '3B' of a heated metal blank in FIG. 1.

For example, and with reference to FIGS. 3A-3B, a heated blank 160*a* in a nominal position '3A' at the furnace exit station 130 in FIG. 1 is shown FIG. 3A and a heated blank 160*a* in an offset position '3B' at the furnace exit station 130 in FIG. 1 is shown FIG. 3B. The heated blank 160*a* in the nominal position 3A has a longitudinal axis 'LA' co-linear with the x-axis of an x-y reference system and a rear (−x direction) edge 166 aligned with and adjacent to the y-axis. In contrast, the heated blank 160*a* in the offset position 3B has a longitudinal axis LA offset from the x-axis of the x-y reference by an angle offset value 'θ'. In addition, and in some variations, the rear edge 166 of the heated blank 160*a* in the offset position 3B is offset from the y-axis by an offset length value 'Δx'. And in at least one variation a position or point where the longitudinal axis LA intersects the rear edge 166 of the heated blank 160*a* is offset from the x-axis by an offset width value 'Δy.' Accordingly, the heated blank 160*a* in the offset position 3B is rotated relative to a length direction 'A' (FIG. 1) of the conveyor 120 by an amount or angle θ, shifted along the length direction by an amount or distance Δx, and shifted along a width direction (i.e., the y direction in the figures) by an amount or distance Δy.

Referring back to FIG. 1, the system 10 includes an electronic vision system 190 configured to determine the position(s) of the heated blanks 160*a* at the furnace exit station 130. One non-limiting example of such an electronic vision system is a Basler aca4096-30uc area scan camera in combination with Raspberry Pi 4 a single-board computer.

The electronic vision system 190 captures one or more images of the heated blanks 160*a* at the furnace exit station 130 and from the captured image(s) one or more offset values (e.g., Δx, Δy, and/or θ) relative to a nominal value or position are determined. In some variations, the electronic vision system 190 includes an electronic vision system (EVS) controller 192 configured to determine or calculate the one or more offset values and transmit the one or more offset values to a system controller 195. In the alternative, or in addition to, the system controller 195 is configured to process one or more images captured by the electronic vision system 190 and determine or calculate the one or more offset values. And in some variations, a programmable logic controller (PLC) 180 assigned to the robot 150 is included with the system 10 and configured to be instructed by the EVS controller 192 and/or controller 195 and command the robot 150 to adjust a position where subsequent metal blanks 160 are placed on the furnace entry station 110 in order to compensate for the one or more offset values mentioned above.

Figure 4A:
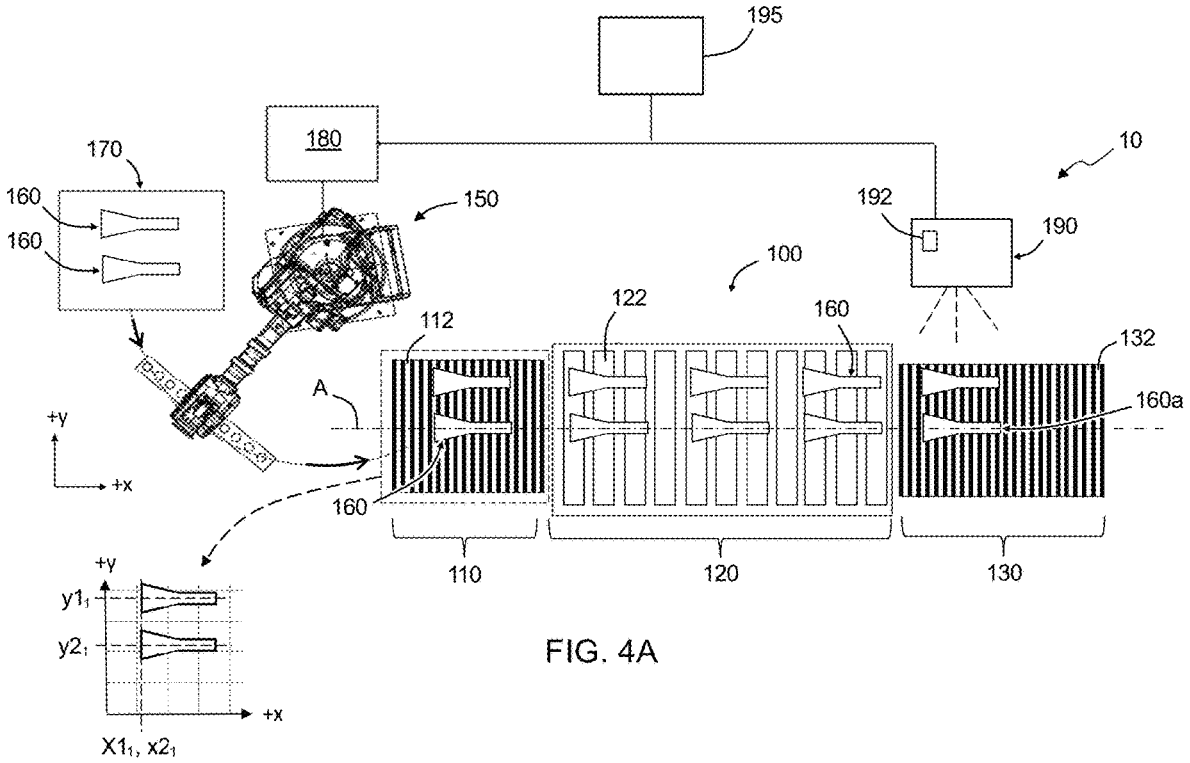
FIG. 4A shows metal blanks being placed on a furnace entry station at a first position and being transported through the furnace of the system in FIG. 1.
Figure 4B:
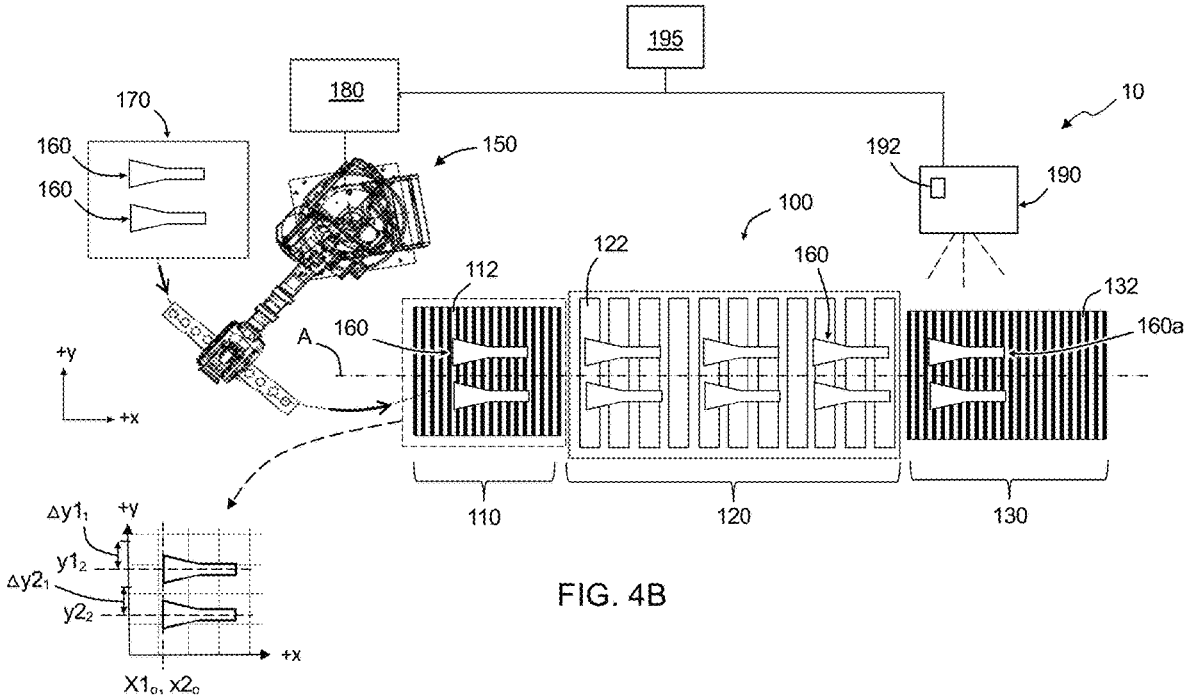
FIG. 4B shows metal blanks being placed on the furnace entry station at a second position and being transported through the furnace of the system in FIG. 1.
Figure 4C:
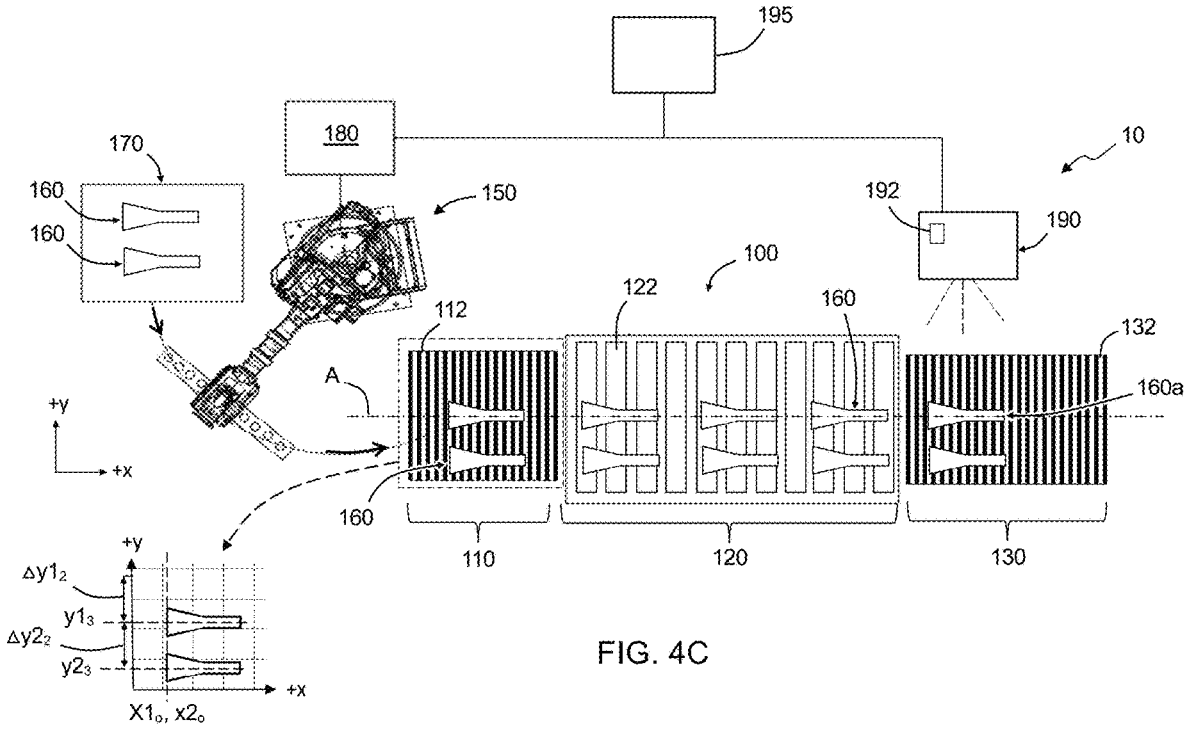
FIG. 4C shows metal blanks being placed on the furnace entry station at a third position and being transported through the furnace of the system in FIG. 1.

Referring now to FIGS. 4A-4C, an example of adjusting a position of where subsequent metal blanks 160 are placed on the furnace entry station 110 (also referred to herein as the "position placement") according to one form of the present disclosure and referred to herein as a "phase one protocol" is shown. During the phase one protocol, the PLC 180 is instructed and commands the robot 150 to adjust the position placement of subsequent metal blanks 160 along the width direction (y direction in the figures) of the furnace entry station 110. It should be understood that the width direction of the furnace entry station 110 corresponds to a length direction (y direction in the figures) of the rollers 122. Particularly, the EVS controller 192 and/or the system controller 195 instructs the PLC 180 to command the robot 150 to adjust or change the width position placement of subsequent metal blanks 160 on the furnace entry station 110 and similarly adjust or change the width position of subsequent metal blanks 160 on the furnace entry station 110.

In some variations, the EVS controller 192 and/or the system controller 195 instructs the PLC 180 to command the robot 150 to place subsequent metal blanks 160 at a position (s) on the furnace entry station 110 corresponding to a length or a section of length of the rollers 122 that has not been used during a heating or hot stamping campaign. For example, in at least one variation the EVS controller 192 and/or the system controller 195 keeps track of or records the number of metal blanks 160 that have passed through the furnace 100 during a given heating or hot stamping campaign. And when a predetermined number (e.g., 50, 100, 200, 500, 1000, among others) of metal blanks 160 have passed through the furnace 100, and thus have rolled over the rollers 122, the EVS controller 192 and/or the system controller 195 instructs the PLC 180 to command the robot 150 to adjust the position placement of subsequent metal blanks 160. For example, the PLC 180 commands the robot 150 to adjust placement of subsequent metal blanks 160 from the first width direction positions $y1_1$, $y2_1$ shown in FIG. 4A to a second width direction positions $y1_2$, $y2_2$ shown in FIG. 4B. Stated differently, the position placement of subsequent metal blanks 160 on the furnace entry station 110 is adjusted by the predetermined offset amounts (offset values) $\Delta y1_1$, $\Delta y2_1$ shown in FIG. 4B.

In addition, and in some variations of the present disclosure, when another predetermined number (e.g., 50, 100, 200, 500, 1000, among others) of metal blanks 160 have passed through the furnace 100 during the given heating or hot stamping campaign, and thus rolled over the rollers 122, the EVS controller 192 and/or the system controller 195 instructs the PLC 180 to command the robot 150 to adjust placement of subsequent metal blanks 160 from the second width direction positions $y1_2$, $y2_2$ shown in FIG. 4B to a third width direction positions $y1_3$, $y2_3$ shown in FIG. 4C. Stated differently, the position placement of subsequent metal blanks 160 on the furnace entry station 110 is adjusted by the predetermined offset amounts (offset values) $\Delta y1_2$, $\Delta y2_2$ shown in FIG. 4C.

While FIGS. 4A-4C show a first adjustment and a second adjustment to the width position placements of subsequent metal blanks 160, it should be understood that the system 10 is configured to make more than two adjustments to width position placements of subsequent metal blanks 160 during a hot stamping campaign. It should also be understood that the system 10 is configured to use knowledge and/or data of prior hot stamping campaigns during the phase one protocol. Non-limiting examples of such knowledge and/or data include performance data of the rollers 122, inspection data of the rollers 122, repair data of the rollers 122, replacement data of the rollers 122, among others.

Figure 5:
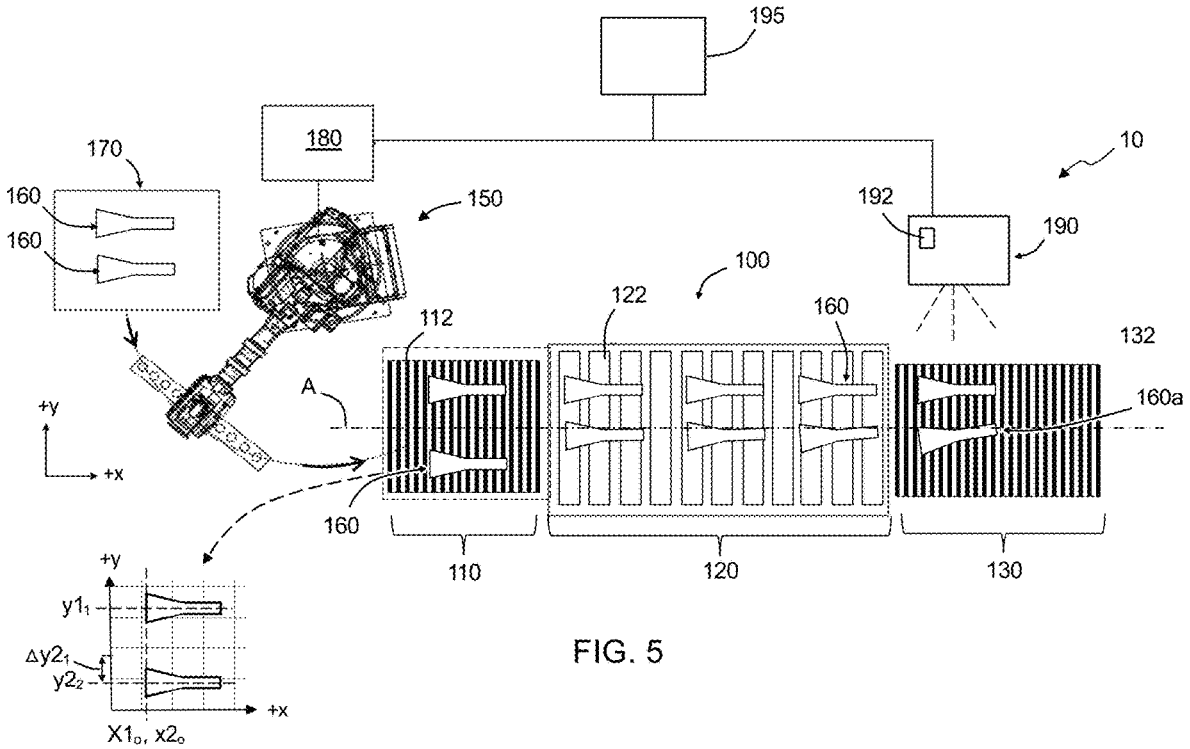
FIG. 5 shows the system in FIG. 1 with a first subset of metal blanks being placed on the furnace entry station at the first position shown in FIG. 4A and a second subset of metal blanks being placed on the furnace entry station at the third position shown in FIG. 4C.

Referring to FIG. 5, the phase one protocol can include the EVS controller 192 and/or the system controller 195 instructing the PLC 180 to command the robot 150 to adjust the position placement of only a subset of subsequent metal blanks from a first width direction position (e.g., $y2_1$) to a second width direction position (e.g., $y2_2$). In one non-limiting example, the EVS controller 192 and/or the system controller 195 instructing the PLC 180 to command the robot 150 to adjust the position placement of only a subset of subsequent metal blanks based on the knowledge and/or data of prior hot stamping campaigns as discussed above. In another non-limiting example the EVS controller 192 and/or the system controller 195 instructing the PLC 180 to command the robot 150 to adjust the position placement of only a subset of subsequent metal blanks when heated blanks 160*a* at the furnace exit station 130 have at least one offset value that is equal to or greater than a predetermined tolerance value. As shown in FIG. 5, the metal blanks 160 rotate about the z-axis as the metal blanks 160 move through the furnace 100 such that a heated blank 160*a* has a $\Delta\theta$ offset value relative to a length direction A. Also, the $\Delta\theta$ offset value is equal to or greater than a predetermined 40 offset parameter and the electronic vision system 190 in combination with the EVS controller 192 and/or controller 195 is configured to detect the $\Delta\theta$ offset value and instruct the PLC 180 to command the robot 150 to move the subsequent metal blank 160 (and other subsequent metal blanks 160) from the first width direction position $y2_1$ to the second width direction position $y2_2$. Accordingly, the system 10 moves or transports subsequent metal blanks 160 through the furnace 100 on a length or section of length of the rollers 122 that has not been exposed to the corrosion resistant coating 164, thereby providing heated blanks 160*a* at the furnace exit station 130 at a desired nominal position. Also, the system 10 ensures that the entire length or a predetermined length of the rollers 122 is used to transport metal blanks 160 from the furnace entry station 110 to the furnace exit station 130 and thereby extends the time period between shutdowns and maintenance of the furnace 100. For example, in some variations the rollers 122 have an overall length of about 114 inches with a total exposed length of about 90 inches and a desired useable length of the rollers being about 82 inches. In such an example the entire length of the rollers 122 is about 90 inches and the predetermined length of the rollers is about 82 inches. While FIG. 5 shows the position placement of only one subset of the metal blanks 160 (i.e., the lower (−y direction) row of metal blanks 160) being adjusted, it should be understood that the position placement of more than one subset of metal blanks 160 can be adjusted as described above.

Figure 6:
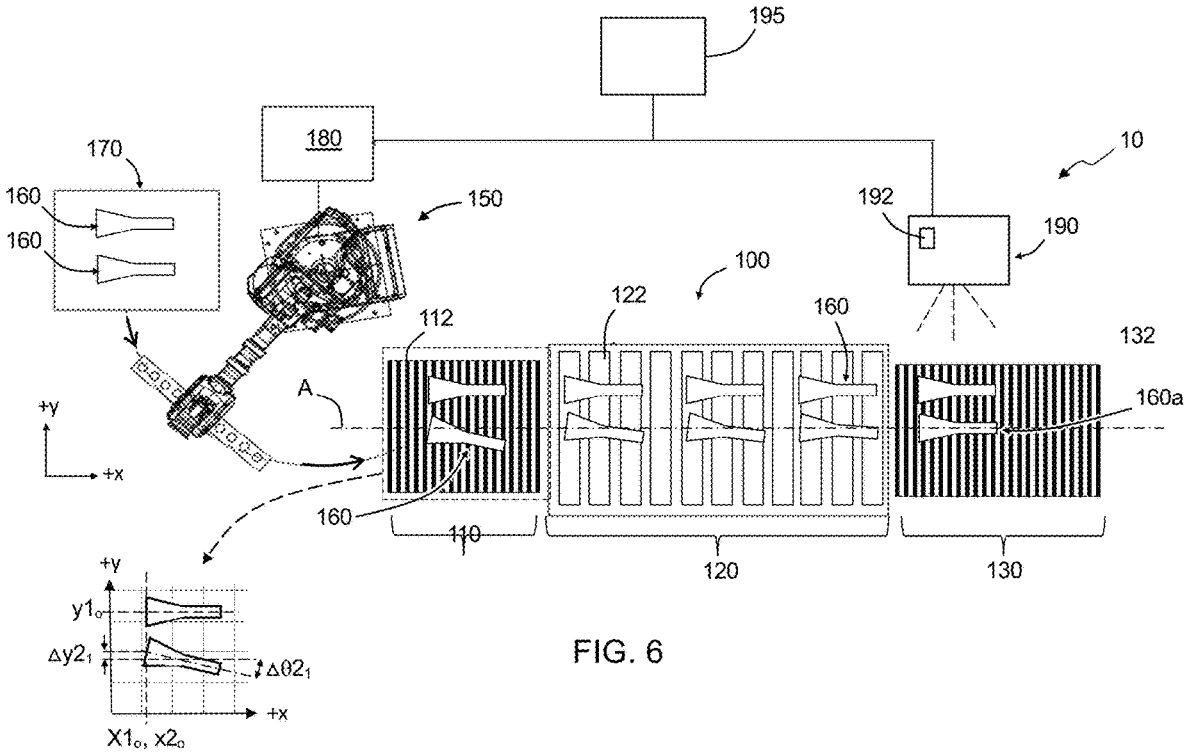
FIG. 6 shows the system in FIG. 1 with a first subset of metal blanks being placed on the furnace entry station at the first position shown in FIG. 4A and a second subset of metal blanks being placed on the furnace entry station at a fourth position.

Referring to FIG. 6, an example of adjusting the position placement of subsequent metal blanks 160 at the furnace entry station 110 according to another form of the present disclose, and referred to herein as a "phase two protocol", is shown. During the phase two protocol, the PLC 180 is instructed and commands the robot 150 to adjust the position placement of o a subset of subsequent metal blanks 160 by rotating the subsequent metal blanks relative to the length direction A. For example, and assuming the metal blanks 160 rotate about the z-axis as the metal blanks 160 move through the furnace 100 such that one or more heated blanks 160*a* have the 40 offset value as shown in FIG. 5, the EVS controller 192 and/or the system controller 195 instructs the PLC 180 to command the robot 150 to adjust or change the angular position of the subset of subsequent metal blanks 160 by $\Delta\theta 2_1$ shown in FIG. 6 such that rotation of the subset of subsequent metal blanks 160 moving through the furnace 100 provides or results in heated blanks 160*a* arriving at the furnace exit station 130 at a desired nominal position. Accordingly, the system 10 transports subsequent metal blanks 160 through the furnace 100 such that time period between shutdowns and maintenance of the furnace 100 is extended. While FIG. 6 shows the position placement of only one subset of the metal blanks 160 (i.e., the lower (−y direction) row of metal blanks 160) being adjusted, it should be understood that the position placement of more than one subset of metal blanks 160 can be adjusted as described above. Also, it should also be understood that the system 10 is configured to use knowledge and/or data of prior hot stamping campaigns during the phase two protocol. Non-limiting examples of such knowledge and/or data include performance data of the rollers 122, inspection data of the rollers 122, repair data of the rollers 122, replacement data of the rollers 122, among others.

Figure 7:
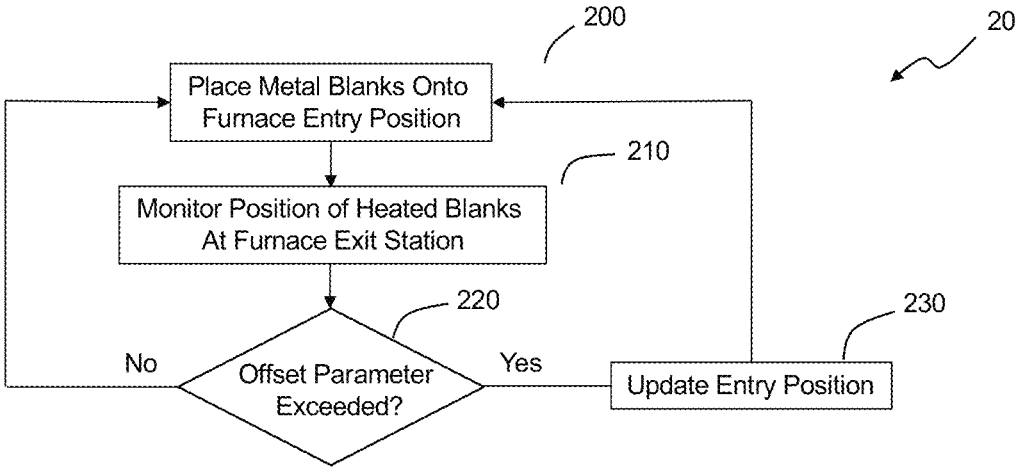
FIG. 7 is a flow chart for a method according to the teachings of the present disclosure.

Referring to FIGS. 1 and 7, a flow chart for a method 20 of heating metal blanks and/or operating the system 10 is shown. The method 20 includes placing metal blanks 160 onto a furnace entry station 110 at an entry position at step 200 and monitoring the positions of heated blanks 160*a* at the furnace exit station 130 at step 210. For example, the electronic vision system 190 in combination with the EVS controller 192 and/or controller 195 monitor the positions of heated blanks 160*a* at the furnace exit station 130 at step 210. At step 220 the system 10, e.g., the electronic vision system 190 in combination with the EVS controller 192 and/or controller 195, determines if one or more of the heated blanks 160*a* arrive at the furnace exit station 130 have a position with an offset value that is equal to or exceeds a predetermined tolerance parameter. If the heated blanks 160*a* arriving at the furnace exit station 130 do not have a position with an offset value that is equal to or exceeds a predetermined tolerance parameter, the method 20 proceeds back to step 200 where the robot 150 continues to place subsequent metal blanks 160 onto the furnace entry station 110 at the entry position. In the alternative, If the heated blanks 160*a* arriving at the furnace exit station 130 do have a position with an offset value that is equal to or exceeds a predetermined tolerance parameter, the method 20 proceeds back to step 230 where the EVS controller 192 and/or controller 195 updates the entry position and instructs the robot 150 to place subsequent metal blanks 160 onto the furnace entry station 110 at the updated entry position at step 200. As noted above, it should be understood that the method 20 can include using knowledge and/or data of prior hot stamping campaigns to update or calculate the updated entry position. Non-limiting examples of such knowledge and/or data include performance data of the rollers 122, inspection data of the rollers 122, repair data of the rollers 122, replacement data of the rollers 122, among others.

Figure 8:
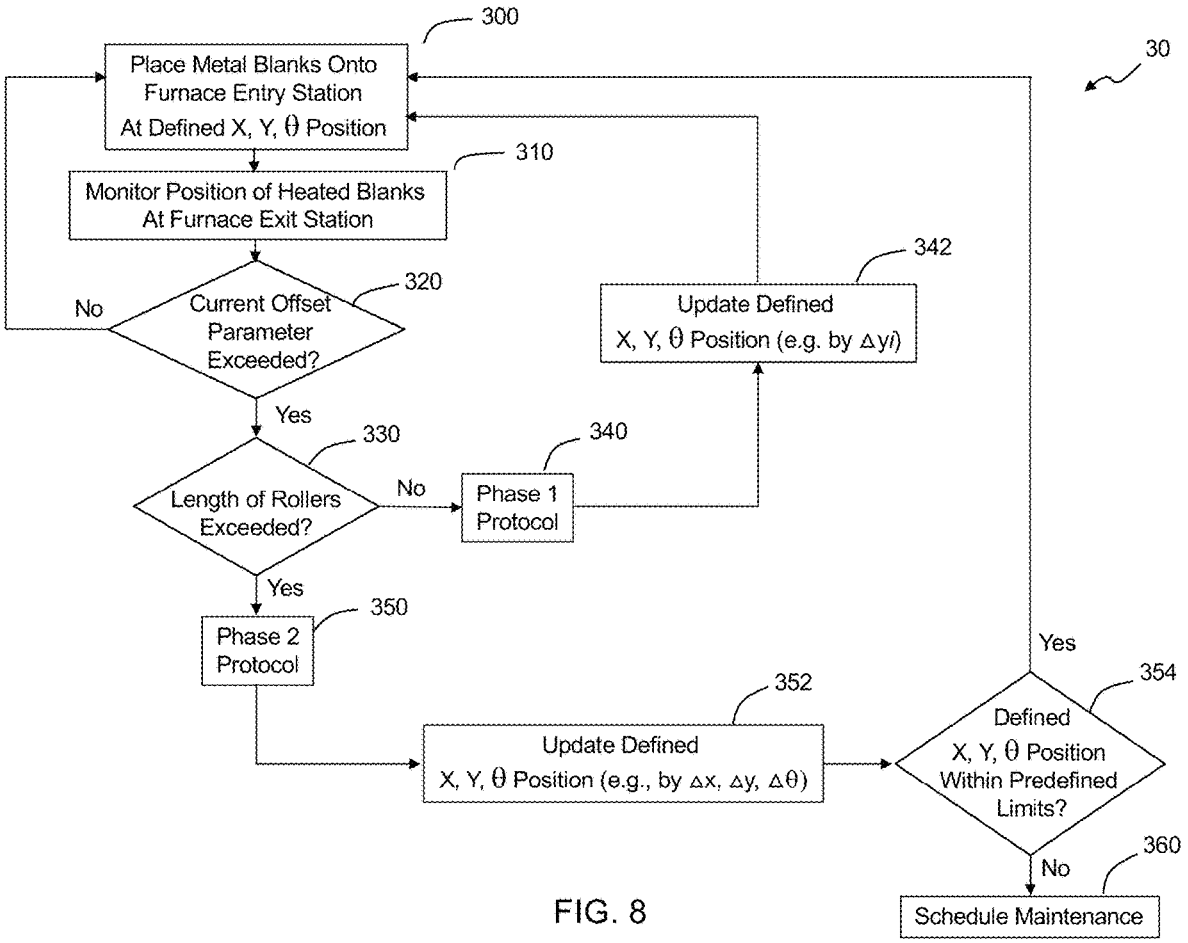
FIG. 8 is a flow chart for another method according to the teachings of the present disclosure.

Referring to FIGS. 1 and 8, a flow chart for a method 30 of heating metal blanks and/or operating the system 10 is shown. The method 30 includes placing metal blanks 160

(e.g., with the robot 150) onto the furnace entry station 110 at a defined x, y, 0 entry position (e.g., $x_1$, $y_1$, $\theta_1$) at step 300 and monitoring the positions of the heated blanks 160*a* at the furnace exit station 130 at step 310. In some variations the positions of the heated blanks 160*a* at the furnace exit station 130 are monitored using the electronic vision system 190 and the EVS controller 192 and/or the controller 195.

The method 30 proceeds to step 320 where the system 10 determines if a position of one or more of the heated blanks 160*a* has an offset value that is equal to or greater than a predetermined tolerance parameter. If the offset value for one or more of the heated blanks 160*a* at the furnace exit station 130 is not equal to or greater than the predetermined tolerance parameter, then the method 30 returns to step 300 where the robot 150 continues to place subsequent metal blanks 160 onto the furnace entry station 110 at the defined $x_1$, $y_1$, θ1 entry position.

In the alternative, if the offset value for one or more of the heated blanks 160*a* at the furnace exit station 130 is equal to or greater than the predetermined tolerance parameter, then the method 30 proceeds to step 330 where the system 10 determines if a predetermined length or a predetermined section of the length of the rollers 122 has been used for transporting the metal blanks 160 through the furnace 100. In some variations the predetermined length of the rollers 122 is the entire length of the rollers 122 within the furnace 100. In other variations the predetermined length of the rollers 122 is less than the entire length of the rollers 122 within the furnace 100.

If the predetermined length of the rollers 122 has not been used for transporting the metal blanks 160 through the furnace 100, the method 30 proceeds to a phase one protocol at step 340 and the defined x, y, θ entry position of the metal blanks is updated or adjusted along a width direction of the furnace entry station 110 (e.g., $x_1$, $y_2$, $\theta_1$ where $y_2=y_1+\Delta y_1$) at step 342. The method 30 proceeds to step 300 where the metal blanks 160 are placed at the furnace entry station 110 at the updated defined $x_1$, $y_2$, $\theta_1$ position.

The method 30 repeats the cycle of steps 310, 320, 330, 340, 342, 300 (i.e., the phase one protocol) until the predetermined length of the rollers 122 is exceeded at step 330, after which the method 30 proceeds to a phase two protocol at step 350 and the currently defined phase one x, y, θ entry position of the metal blanks is updated or adjusted (e.g., by Δx, Δy and/or Δθ) at step 352. At step 354 the system 10 determines if the updated x, y, θ entry positions (e.g., $x_4$, $y_4$, $\theta_4$) are within predefined phase two protocol x, y, θ limits. If the updated $x_4$, $y_4$, $\theta^4$ entry positions are within predefined phase two protocol x, y, θ limits, the method 30 proceeds to step 300 where the metal blanks 160 are placed at the furnace entry station 110 at the updated defined $x_4$, $y_4$, $\theta_4$ position. The method 30 repeats the cycle of steps 310, 320, 330, 350, 352, 354, 300 (i.e., the phase two protocol) until the updated x, y, θ entry positions (e.g., $x_9$, $y_9$, $\theta_9$) are not within the predefined phase two protocol x, y, θ limits, after which the method proceeds to alert a user to schedule maintenance at step 360.

It should be understood from the teachings of the present disclosure that a system and method for heating metal blanks is provided. The system and method use an electronic vision system to determine the offset position(s) of one or more heated metal blanks exiting a furnace, compare the offset position(s) to one or more nominal (reference) positions of the one or more heated blanks exiting the furnace, and adjust an entry position or entry positions of subsequent metal blanks entering the furnace. Adjustment of the entry position or entry positions of the subsequent metal blanks entering the furnace accounts for movement (e.g., rotation) of the subsequent metal blanks moving through the furnace such that heated metal blanks at the one or more nominal positions exit the furnace. Exiting of the heated metal blanks at the one or more nominal positions from the furnace enhances grasping and placement of the heat blanks into a hot stamping press. Also, adjustment of the entry position or entry positions of the subsequent metal blanks entering the furnace increases the length of rollers in the furnace used during a hot stamping campaign and thereby provides for increased time periods between scheduled shutdown and maintenance of the furnace. In some variations shutdowns and maintenance are scheduled and performed before heat metal blanks exiting the furnace become offset from the one or more nominal positions.

In this application, the term "module" and/or "controller" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

Words used to describe the relationship between elements should be interpreted in like fashion (e.g., "between" versus "directly between," "adjacent" versus "directly adjacent," etc.). As used herein, the term "and/or" includes any and all combinations of one or more of the associated listed items.

Although the terms first, second, third, etc. may be used to describe various elements, components, regions, layers and/or sections, these elements, components, regions, layers and/or sections, should not be limited by these terms. These terms may be only used to distinguish one element, component, region, layer and/or section, from another element, component, region, layer and/or section. Terms such as "first," "second," and other numerical terms when used herein do not imply a sequence or order unless clearly indicated by the context. Thus, a first element, component, region, layer or section, could be termed a second element, component, region, layer or section without departing from the teachings of the example forms. Furthermore, an element, component, region, layer or section may be termed a "second" element, component, region, layer or section, without the need for an element, component, region, layer or section termed a "first" element, component, region, layer or section.

Specially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above or below. The device may be otherwise oriented (rotated 90 degrees or at other orientations) and the spatially relative descriptors used herein interpreted accordingly.

As used herein, the phrase at least one of A, B, and C should be construed to mean a logical (A OR B OR C), using a non-exclusive logical OR, and should not be construed to mean "at least one of A, at least one of B, and at least one of C."

Unless otherwise expressly indicated, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, manufacturing technology, and testing capability.

The terminology used herein is for the purpose of describing particular example forms only and is not intended to be limiting. The singular forms "a," "an," and "the" may be intended to include the plural forms as well, unless the context clearly indicates otherwise. The terms "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A method of adjusting a position of a blank entering a furnace, the method comprising:

measuring a position of a heated blank exiting the furnace and recording one or more offset values from a nominal value of the heated blank exiting the furnace;

calculating a revised position of a subsequent blank entering the furnace as a function of the one or more offset values; and adjusting a position of the subsequent blank entering the furnace as the function of the one or more offset values.

2. The method according to claim 1, wherein the position of the heated blank exiting the furnace is measured with an electronic vision system.

3. The method according to claim 1, wherein the one or more offset values comprise at least one of an elapsed furnace operation time during a heating campaign, a number of heated blanks that have exited the furnace during the heating campaign, and a physical dimension between the position of the heated blank exiting the furnace and the nominal value of the heated blank exiting the furnace.

4. The method according to claim 3, wherein the physical dimension is at least one of a width offset value, a length offset value, and an angle offset value of the measured position of the heated blank exiting the furnace and a nominal position of the heated blank exiting the furnace.

5. The method according to claim 1, wherein measuring the position of the heated blank comprises measuring the position of a plurality of heated blanks exiting the furnace, and adjusting the position of the subsequent blank comprises adjusting the position of a plurality of subsequent blanks entering the furnace.

6. The method according to claim 5, wherein adjusting the position of the plurality of subsequent blanks comprises adjusting the position of at least a subset of the plurality of subsequent blanks along a width direction of a furnace entry station.

7. The method according to claim 5, wherein adjusting the position of the plurality of subsequent blanks comprises adjusting at least one of a width placement value, a length placement value, and an angle placement value of at least a subset of the plurality of subsequent blanks relative to a length direction of a conveyor transporting the plurality of subsequent blanks through the furnace.

8. The method according to claim 1, wherein adjusting the position of the subsequent blank comprises adjusting the position of a plurality of subsequent blanks during a first phase protocol and a second phase protocol, wherein the first phase protocol comprises adjusting a position of a first subset of the plurality of subsequent blanks entering the furnace along a width direction of a furnace entry station.

9. The method according to claim 8, wherein the second phase protocol comprises adjusting a position of a second subset of the plurality of subsequent blanks entering the furnace about an angle relative to a length direction of the conveyor transporting the plurality of subsequent blanks through the furnace.

10. The method according to claim 9 further comprising commanding a robot to adjust the position of the first subset of the plurality of subsequent blanks during the first phase protocol and to adjust the position of the second subset of the plurality of subsequent blanks during the second phase protocol.

11. The method according to claim 10, wherein the robot continually adjusts the first subset of the subsequent blanks along the width direction of the conveyor of the furnace until a predefined length of rollers used to transport the plurality of subsequent blanks through the furnace during the first phase protocol.

12. The method according to claim 1, wherein the furnace is a roller furnace.

13. The method according to claim 1, wherein the first blank and the subsequent blank are coated steel blanks.

14. The method according to claim 1, wherein the first blank and the subsequent blank are aluminum coated steel blanks.

15. The method according to claim 1 further comprising hot stamping the first blank.

16. A method of adjusting positions of blanks entering a hot stamping furnace, the method comprising:

measuring positions of a plurality of heated blanks exiting the hot stamping furnace with an electronic vision system;

determining and recording one or more offset values from a nominal value for at least a portion of the plurality of heated blanks exiting the hot stamping furnace; and commanding a robot to adjust positions of a plurality of subsequent blanks entering the hot stamping furnace as a function of the one or more offset values.

17. The method according to claim 16, wherein the robot adjusts the positions of the plurality of subsequent blanks along a width direction of a furnace entry station.

18. The method according to claim 16, wherein the robot adjusts the positions of the plurality of subsequent blanks about an angle relative to a length direction of a conveyor transporting the subsequent blanks into the hot stamping furnace.

19. A method of adjusting positions of blanks entering a hot stamping furnace, the method comprising:

measuring positions of a plurality of heated blanks exiting the hot stamping furnace and determining one or more offset values from nominal values for at least a portion of the plurality of blanks;

calculating at least one revised position of a plurality of subsequent blanks that will enter the hot stamping furnace as a function of the one or more offset values; and commanding a robot to place the plurality of subsequent blanks at the at least one revised position before entering the hot stamping furnace.

20. The method according to claim 19, wherein the one or more offset values comprise at least one of a number of blanks that have exited the hot stamping furnace, an elapsed time of operation of the hot stamping furnace, and a difference between the measured positions of the plurality of blanks that have exited the hot stamping furnace and at least one nominal position of the plurality of blanks that have exited the hot stamping furnace.

* * * * *